US006874441B2

(12) United States Patent
Pigeon

(10) Patent No.: US 6,874,441 B2
(45) Date of Patent: Apr. 5, 2005

(54) BOAT WITH WAKE CONTROL

(75) Inventor: Charles F. Pigeon, Abilene, TX (US)

(73) Assignee: Tige Boats, Inc., Abilene, TX (US)

( * ) Notice: Subject to any disclaimer, the term of this patent is extended or adjusted under 35 U.S.C. 154(b) by 0 days.

(21) Appl. No.: 10/607,349

(22) Filed: Jun. 26, 2003

(65) Prior Publication Data

US 2004/0261684 A1 Dec. 30, 2004

(51) Int. Cl.[7] ..... B63B 1/22
(52) U.S. Cl. ..... 114/285
(58) Field of Search ..... 114/271, 284–287, 114/126

(56) References Cited

U.S. PATENT DOCUMENTS

| | | | | |
|---|---|---|---|---|
| 1,003,364 A | | 9/1911 | Langston | |
| 1,779,075 A | | 10/1930 | Plum | |
| 1,880,366 A | * | 10/1932 | Smedley | 114/271 |
| 3,371,642 A | * | 3/1968 | Joy | 114/285 |
| 3,435,795 A | | 4/1969 | Eckfield | |
| 3,463,109 A | | 8/1969 | Weiler | |
| 3,678,874 A | * | 7/1972 | Flink | 114/285 |
| 3,707,936 A | | 1/1973 | Harris | |
| 4,597,742 A | | 7/1986 | Finkl | |
| 4,909,175 A | | 3/1990 | Arnseson | |
| 5,524,567 A | | 6/1996 | Astley et al. | |
| 5,704,308 A | | 1/1998 | Anderson | |
| 5,881,666 A | | 3/1999 | Crews, Jr. | |
| 6,038,995 A | * | 3/2000 | Karafiath et al. | 114/271 |
| 6,095,077 A | | 8/2000 | DeAgro | |
| 6,138,601 A | | 10/2000 | Anderson et al. | |
| 6,571,724 B1 | * | 6/2003 | Shen | 114/284 |
| 6,688,743 B1 | * | 2/2004 | Durnin et al. | 356/369 |
| 6,745,715 B1 | * | 6/2004 | Shen et al. | 114/284 |

* cited by examiner

*Primary Examiner*—Jesus D. Sotelo
(74) *Attorney, Agent, or Firm*—Haynes and Boone, LLP.

(57) ABSTRACT

A boat comprising a hull having an end portion that is curved inwardly. A plate is pivotally mounted to the boat for movement between a first position in which it extends downwardly and a second position in which it extends upwardly.

10 Claims, 4 Drawing Sheets

BOAT WITH WAKE CONTROL

The present invention relates to a propeller-driven boat, including the type for towing people in connection with water sports, such as water skiing, wakeboarding, and the like.

Many propeller-driven boats are designed to tow people with a specific water sport in mind. For example, some are designed to tow water skiers and produce relatively small wakes that do not interfere with the skiing. According to some of these latter designs, the lower surface of the trailing end portion of the hull of the boat is often hooked, or tapered outwardly from the axis of the boat, so that it reacts with the water to raise the trailing end, or stern, of the boat upwardly, causing the hull to ride substantially flat across the water at a relatively low angle of attack. Also, many boats that are used for water skiing include a trim plate in combination with a substantially flat lower hull surface, or a tapered one as described above. The trim plate extends outwardly and downwardly from the boat's transom and reacts with the water to further promote the raising of the trailing end, or stern, of the boat upwardly, also for the purpose of insuring that the hull rides substantially flat across the water to produce minimum wakes.

However, these types of designs are not suitable for other water sports, such as wakeboarding, that require relatively large wakes that are produced only when the leading end, or bow, of the boat is raised out of the water at a relatively high angle of attack. (This relatively high angle of attack causes the trailing end, or stern, of the boat to sit down into the water so that it effectively digs a trench through the water, which produces the relatively large wakes.)

Thus, it can be appreciated that a boat designed to produce relatively small wakes for water skiing performs less than optimally for producing relatively large wakes for wakeboarding, and vice versa.

The embodiments of the boat of the present invention overcome these deficiencies.

DETAILED DESCRIPTION

Figure 1:
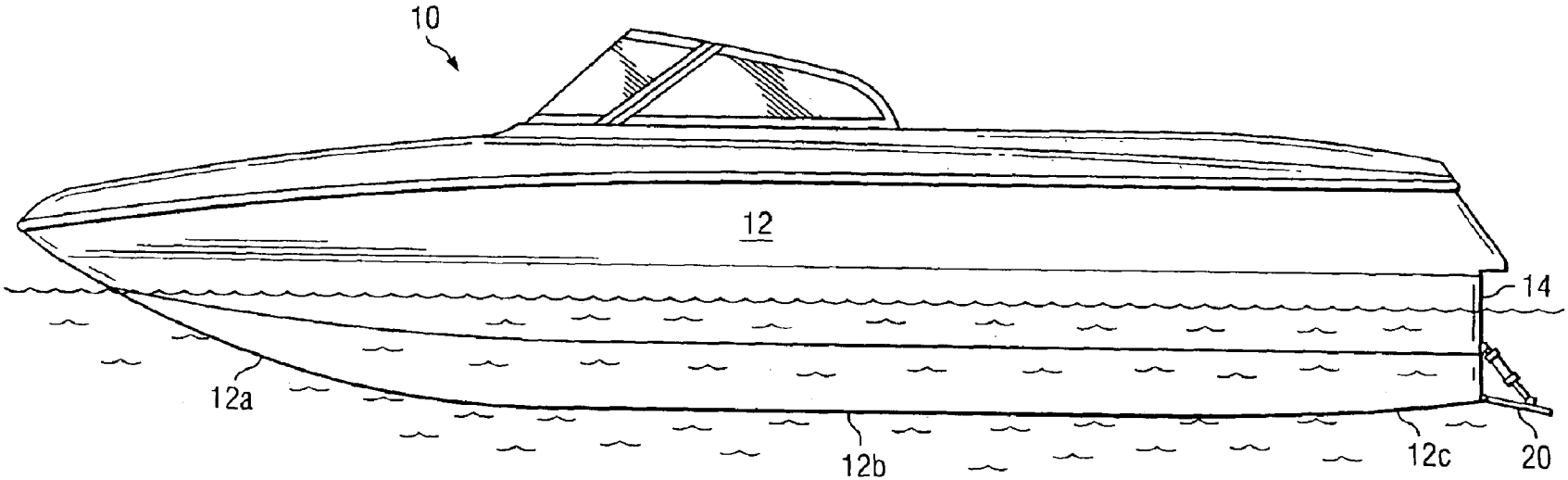
FIG. 1 is a side elevational view of a boat according to an embodiment of the present invention.
Figure 2:
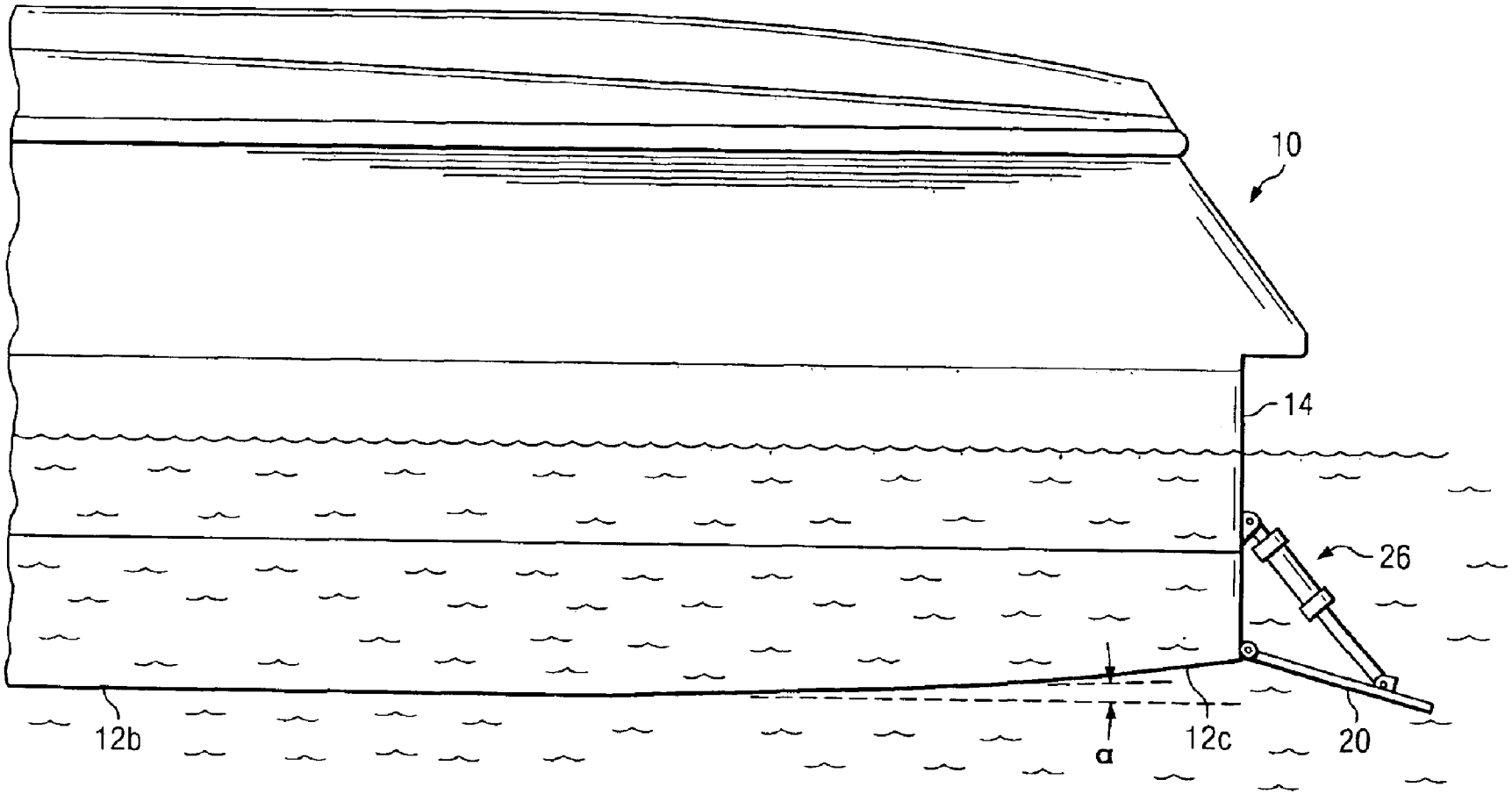
FIG. 2 is a partial enlarged view of a portion of the boat of FIG. 1.

With reference to FIGS. 1 and 2 of the drawings, a boat according to an embodiment of the present invention is shown, in general, by the reference numeral 10. The boat 10 includes a hull 12 extending longitudinally and a transom 14 formed at the trailing end, or stern, of the hull. Although not shown in the drawing, it is understood that the interior of the hull 12 is designed to accommodate passengers and that an inboard motor and propeller are mounted to the hull 12 to propel the boat 10 through water, all in a conventional manner.

The lower surface of the hull 12 includes a leading end portion 12*a* extending from the leading end, or bow or the hull, to the bottom of the hull, a substantially flat portion 12*b* which extends from the curved portion 12*a*, and a trailing end portion 12*c* which extends from the flat portion 12*b* to the trailing end, or transom 14.

As better shown in FIG. 2, the trailing end portion 12*c* extends from the trailing end, or transom 14, of the boat to an area spaced from the transom, and is tapered inwardly from the area to the transom and towards the axis of the boat, which axis is presumed, for the purpose of example to extend along, or parallel to, the waterline, shown in FIG. 1. In particular, the lower surface of the trailing end portion 12*c* is tapered inwardly towards the longitudinal axis of the boat at an acute angle $\alpha$ to the above axis and to the flat portion 12*b* which angle can be in the range of 2 degrees to 20 degrees.

At least a portion of the lower surface of the tapered end portion 12*c* can be straight, at least a portion can be slightly curved and, as shown in the drawing for the purpose of example, one portion can be straight and the remaining portion slightly curved. The purposes and advantages of this shape of the lower surface of the end portion 12*c* are explained in detail below.

Figure 3:
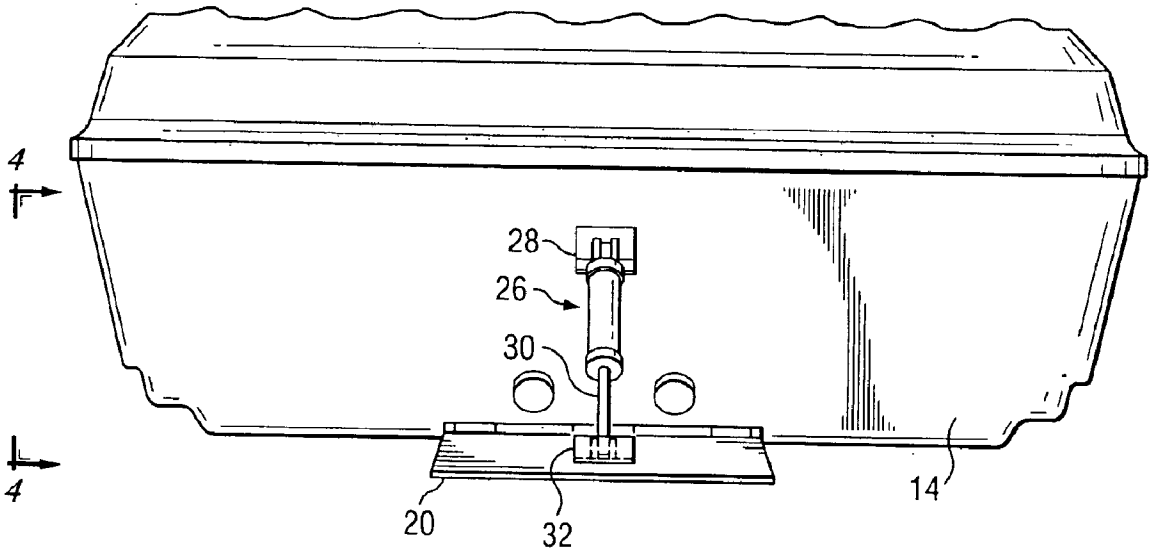
FIG. 3 is an enlarged trailing elevational view of the boat of FIG. 1.
Figure 4:
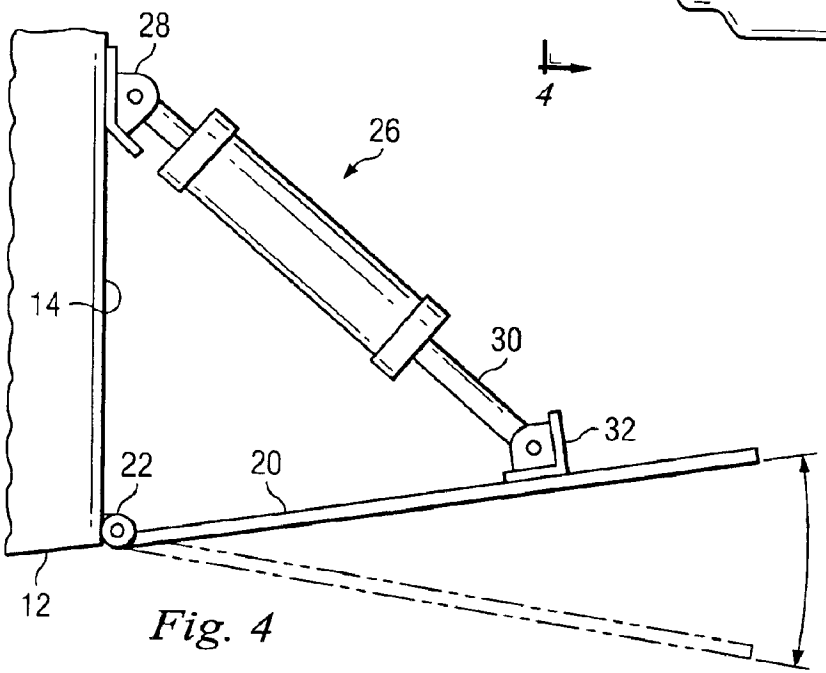
FIG. 4 is an enlarged sectional view taken along the line 4—4 of FIG. 3.

A trim plate 20 is mounted to the transom 14, and is better shown in FIGS. 3 and 4. In particular, the trim plate 20 is pivotally mounted, via a conventional hinge 22, to the transom 14 for movement between the two positions shown in solid lines and phantom lines, respectively, in FIG. 4. In each of these positions, the plate 20 extends at an angle to the longitudinal axis of the boat, for reasons to be described. The plate 20 is positioned along the longitudinal axis of the hull 12, and is rectangular in shape with its major axis extending transverse to the latter axis. As shown in FIG. 3, the maximum width of the plate 20 is substantially less than the maximum width of the hull 12 and, in the example shown in FIG. 3, the maximum width of the plate is less than one-third of the maximum width of the hull.

A hydraulic cylinder assembly 26 is provided midway between the two ends of the plate 20 and is pivotally mounted, by a pivot pin, or the like, to a mounting bracket 28 which, in turn, is mounted to the transom 14. The assembly 26 includes a rod 30, which is pivotally mounted at its distal end by a pivot pin, or the like, to a bracket 32 secured to the upper surface of the plate 20. It is understood that the rod 30 is mounted for reciprocal movement in the housing of the assembly 16 in a conventional manner.

It is also understood that a manually actuatable hydraulic control circuit (not shown) is connected to the assembly 26. This control circuit operates in a conventional manner to control the reciprocal movement of the rod 30 in the housing of the assembly 26 to pivot the plate between the positions shown in FIG. 4. This hydraulic control circuit, as well as other details of the trim plate 20, is more fully disclosed in U.S. Pat. No. 5,549,071, assigned to the assignee of the present invention, and the disclosure of this patent is incorporated by reference.

FIG. 1 depicts the boat 10 with the trim plate 20 in its position shown by the phantom lines in FIG. 4 in which the plate extends outwardly and downwardly from the hull 12 at an acute angle to the longitudinal axis of the boat. In this position, as the boat 10 passes through the water, the end portion 12*c* directs the water to the plate 20 where the upward reaction forces of the water on the plate raises the trailing end, or stem, of the boat upwardly. As a result, the hull 12 rides substantially flat across the water. As discussed above, this position produces relatively small wakes in the water, which is conducive to various types of water skiing.

If it is desired to produce relatively large wakes, such as the type desirable for wakeboarding, and the like, the assembly 26 is actuated by the above-mentioned hydraulic control system which causes the plate 20 to pivot upwardly to the position shown by the solid lines in FIG. 4. In this position the plate 20 extends outwardly and upwardly from the transom 14 and at an acute angle to the longitudinal axis of the boat which angle can be the same as angle α discussed above in connection with the taper of the lower surface of the end portion 12*c* so that the plate 20, in effect, forms an extension of the lower surface of the latter end portion. In this position, neither the lower surface of the end portion 12*c* nor the plate 20 cause any of the above-mentioned reaction forces with the water as discussed above in connection with the water skiing mode. Rather, the thrust forces caused by the above-mentioned propeller in the water raise the leading end, or bow, of the boat 10 out of the water so that the hull 12 is at a relatively high angle of attack, when compared to the relatively low angle of attack of FIG. 1. Thus, the trailing end, or stern, of the boat sits down into the water so that it effectively digs a trench along the path that it makes through the water, which, in turn, produces relatively large wakes.

It is understood that the operator of the boat can utilize the above control circuit to cause pivotal movement of the plate 20 to one or more intermediate positions between the two positions shown in FIG. 4 in the event different positions of the boat 10 in the water are desired.

VARIATIONS AND ALTERNATIVES (1) Although the junction between the adjacent ends of the flat hull portion 12*b* and the end portion 12*c* is shown in the drawings at a relatively short distance from the trailing end of the boat 14 for the purposes of example only, it is understood that this junction can occur anywhere between the trailing end and an area approximately at the mid point of the longitudinal axis of the hull, i.e., at a point approximately between the transom and the leading end, or bow, of the boat. Thus, the expression "end portion" used herein is not limited to the specific length shown in the drawings, but rather this length can vary.

(2) The specific angles that the end portion 12*c* and the plate 20 makes with the axis of the boat 10 can be varied depending on the particular performance desired.

(3) The mechanism for pivoting the trim plate 20 can be varied within the scope of the invention.

Figure 5:
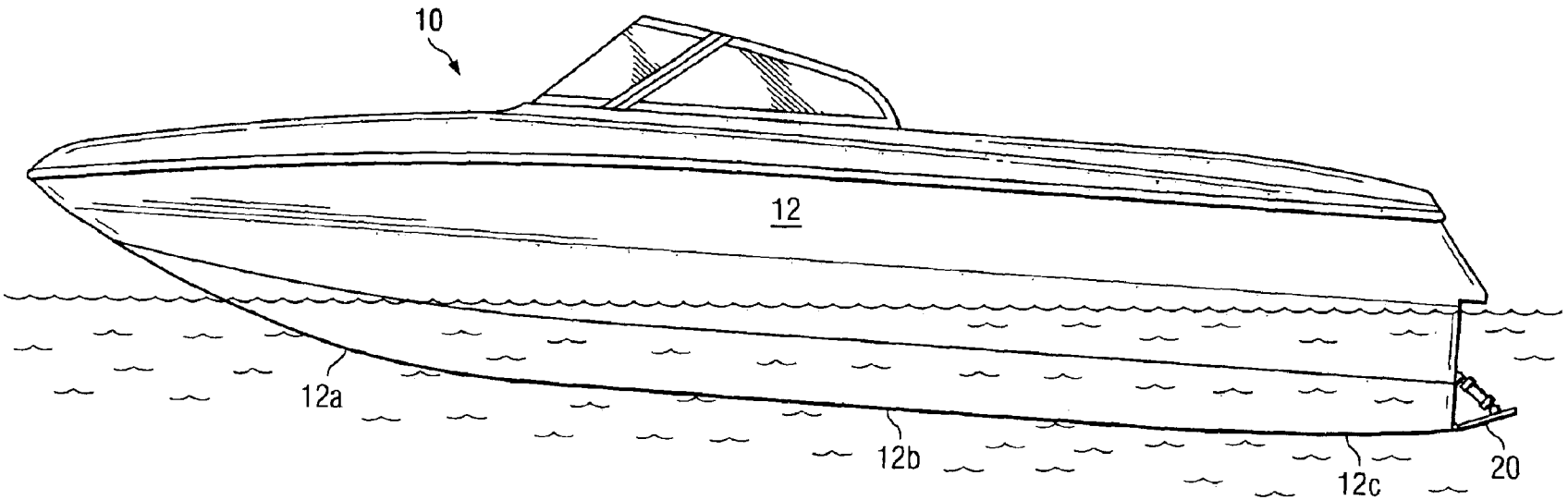
FIG. 5 is a view similar to that of FIG. 1, but depicting the boat in a different position in the water.

(4) In the position of the plate shown in FIG. 5, the plate does not necessarily have to form an extension of the lower surface of the end portion 12*c*.

(5) The lower surfaces of the portions 12*a* and 12*b* of the hull can be adapted to accommodate fins, rudders, and the above mentioned motor.

(6) Some or all of the hull portion 12*b* does not necessarily have to be flat.

(7) The present invention is not limited to inboard motorboats or to boats for towing water skiers, wakeboarders, etc.

Although only a few exemplary embodiments of this invention have been described in detail above, those skilled in the art will readily appreciate that many other modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures.

What is claimed is:

1. A boat adaptable for producing different wakes in water, the boat comprising:

a hull having a longitudinal axis and a trailing end;

the lower surface of the hull being curved towards the axis of the boat from an area spaced from the trailing end to the trailing end; and a plate pivotally mounted to the trailing end and extending rearwardly from the trailing end with its width being less than the width of the hull;

the plate being adapted for movement between a first position in which it extends from the trailing end downwardly at an angle to the axis for reaction with the water so that the trailing end attains a relative high attitude in the water and produces relatively small wakes in the water, and a second position in which it extends from the trailing end upwardly at an angle to the axis so that the trailing end attains a relative low attitude in the water and produces relatively large wakes in the water.

2. The boat of claim 1 wherein a portion of the lower surface of the hull is substantially flat, and wherein the tapered surface extends at an acute angle to the substantially flat portion.

3. The boat of claim 1 wherein the tapered surface extends from the trailing end of the hull to an area between the trailing end and the mid point of the axis.

4. The boat of claim 1 wherein, in the first position of the plate, the upward reaction forces of the water on the plate raises the trailing end of the boat upwardly so that the hull rides substantially flat across the water.

5. The boat of claim 1 wherein, in the second position of the plate, the leading end of the boat is raised out of the water so that the leading end portion of the hull is at a relatively high angle of attack with the water.

6. The boat of claim 5 wherein, in the second position of the plate, the relatively high angle of attack causes the trailing end of the boat to sit down into the water so that it produces the relatively large wakes.

7. The boat of claim 1 wherein at least a portion of the tapered lower surface of the hull is straight.

8. The boat of claim 1 wherein a portion of the lower surface of the hull is curved and a portion is straight.

9. The boat of claim 1 wherein the width of the plate is less than one third of the width of the hull.

10. The boat of claim 1 wherein the width of the plate is less than one half the width of the hull.

* * * * *

UNITED STATES PATENT AND TRADEMARK OFFICE

CERTIFICATE OF CORRECTION

PATENT NO. : 6,874,441 B2
DATED : April 5, 2005
INVENTOR(S) : Charles F. Pigeon

It is certified that error appears in the above-identified patent and that said Letters Patent is hereby corrected as shown below:

Column 2,
Line 62, delete “stem” replace with “stern”

Column 4,
Line 13, insert -- longitudinal -- before “axis”
Line 14, delete “of the boat”
Lines 33, 35 and 50, delete “tapered” replace with -- curved --

Signed and Sealed this

Seventh Day of June, 2005

JON W. DUDAS
*Director of the United States Patent and Trademark Office*